US008644537B1

(12) United States Patent
Howes et al.

(10) Patent No.: US 8,644,537 B1
(45) Date of Patent: Feb. 4, 2014

(54) EXPANDING BINAURAL HEARING ASSISTANCE DEVICE CONTROL

(75) Inventors: Christopher Larry Howes, Eden Prairie, MN (US); Dan Edgar, Lakeville, MN (US); Joyce Rosenthal, Golden Valley, MN (US); Jeff Patrick Kryzer, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 13 days.

(21) Appl. No.: 13/340,092

(22) Filed: Dec. 29, 2011

Related U.S. Application Data

(63) Continuation of application No. 11/625,736, filed on Jan. 22, 2007, now Pat. No. 8,107,655.

(51) Int. Cl.
*H04R 25/00* (2006.01)

(52) U.S. Cl.
USPC ..... 381/314; 381/60; 381/312

(58) Field of Classification Search
USPC ..... 381/58, 60, 312, 314, 315, 320, 321, 381/23.1; 73/585; 600/559
See application file for complete search history.

(56) References Cited

U.S. PATENT DOCUMENTS

| | | | | |
|---|---|---|---|---|
| 5,083,312 | A | 1/1992 | Newton et al. | |
| 5,511,157 | A | 4/1996 | Wang | |
| 5,626,629 | A | 5/1997 | Faltys et al. | |
| 5,751,285 | A | 5/1998 | Kashiwagi et al. | |
| 5,802,185 | A | 9/1998 | Hansen | |
| 5,812,688 | A | 9/1998 | Gibson | |
| 5,832,097 | A | 11/1998 | Armstrong et al. | |
| 5,835,611 | A | 11/1998 | Kaiser et al. | |
| 6,097,824 | A | 8/2000 | Lindemann et al. | |
| 6,201,875 | B1 | 3/2001 | Davis et al. | |
| 6,411,289 | B1 | 6/2002 | Zimmerman | |
| 6,449,372 | B1 | 9/2002 | Greminger | |
| 6,574,342 | B1 * | 6/2003 | Davis et al. | 381/314 |
| 6,606,391 | B2 | 8/2003 | Brennan et al. | |
| 6,901,560 | B1 | 5/2005 | Guerlain et al. | |
| 7,054,449 | B2 | 5/2006 | Ludi | |
| 7,366,307 | B2 | 4/2008 | Yanz et al. | |

(Continued)

FOREIGN PATENT DOCUMENTS

| | | | |
|---|---|---|---|
| EP | 0794687 | A1 | 9/1997 |
| EP | 0537026 | B1 | 12/1999 |

OTHER PUBLICATIONS

"U.S. Appl. No. 10/269,524, Advisory Action mailed Jul. 11, 2007", 4 pgs.

(Continued)

*Primary Examiner* — Huyen D Le
(74) *Attorney, Agent, or Firm* — Schwegman Lundberg & Woessner, P.A.

(57) ABSTRACT

Provided herein is a system for adjusting parameters for binaural hearing assistance devices. A graphical user interface (GUI) control is provided for adjusting at least one parameter for at least one hearing assistance device. In various embodiments, the control is indicative of status of at least one parameter for at least one device. When a pointer, controlled by a mouse or other selecting device, is placed over the control, the control expands. In various applications the control expands to display options for adjusting at least one parameter for at least one device. In some applications, the control provides options to adjust at least one parameter of a left and a right device individually.

20 Claims, 4 Drawing Sheets

(56) References Cited

U.S. PATENT DOCUMENTS

| | | | | |
|---|---|---|---|---|
| 7,672,468 | B2 * | 3/2010 | Kaiser et al. | 381/314 |
| 8,107,655 | B1 | 1/2012 | Howes et al. | |
| 2003/0086579 | A1 | 5/2003 | Lashina et al. | |
| 2004/0071304 | A1 | 4/2004 | Yanz | |
| 2006/0098831 | A1 | 5/2006 | Kaiser et al. | |
| 2008/0187146 | A1 | 8/2008 | Yanz et al. | |
| 2012/0269369 | A1 | 10/2012 | Yanz et al. | |

OTHER PUBLICATIONS

"U.S. Appl. No. 10/269,524, Decision mailed Sep. 19, 2007 on Pre-Appeal Brief filed Aug. 2, 2007", 2 pgs.
"U.S. Appl. No. 10/269,524, Examiner Interview Summary mailed Oct. 16, 2007", 2 pgs.
"U.S. Appl. No. 10/269,524, Final Office Action mailed May 2, 2007", 17 pgs.
"U.S. Appl. No. 10/269,524, Non Final Office Action mailed Sep. 19, 2006", 17 pgs.
"U.S. Appl. No. 10/269,524, Notice of Allowance mailed Dec. 13, 2007", NOAR, 8 pgs.
"U.S. Appl. No. 10/269,524, Pre-Appeal Brief filed Aug. 2, 2007", 5 pgs.
"U.S. Appl. No. 10/269,524, Response filed Jan. 19, 2007 to Non Final Office Action mailed Sep. 19, 2006", 19 pgs.
"U.S. Appl. No. 10/269,524, Response filed Jul. 2, 2007 to Final Office Action mailed May 2, 2007", 17 pgs.
"U.S. Appl. No. 10/269,524, Response filed Jul. 12, 2006 to Restriction Requirement mailed Jun. 12, 2006", 17 pgs.
"U.S. Appl. No. 10/269,524, Restriction Requirement mailed Jun. 12, 2006", 6 pgs.
"U.S. Appl. No. 10/269,524, Supplemental Amendment mailed Oct. 5, 2007", 15 pgs.
"U.S. Appl. No. 11/625,736, Non Final Office Action mailed Apr. 14, 2011", 8 pgs.
"U.S. Appl. No. 11/625,736, Notice of Allowance mailed Sep. 29, 2011", 5 pgs.
"U.S. Appl. No. 11/625,736, Response filed Feb. 24, 2011 to Restriction Requirement mailed Feb. 18, 2011", 7 pgs.
"U.S. Appl. No. 11/625,736, Response filed Jul. 14, 2011 to Non-Final Office Action mailed Apr. 14, 2011", 10 pgs.
"U.S. Appl. No. 11/625,736, Restriction Requirement mailed Feb. 18, 2011", 6 pgs.
"U.S. Appl. No. 12/098,869 Restriction Requirement mailed Oct. 14, 2010", 6 pgs.
"U.S. Appl. No. 12/098,869 , Response filed Dec. 1, 2011 to Final Office Action mailed Sep. 1, 2011", 11 pgs.
"U.S. Appl. No. 12/098,869, Advisory Action mailed Dec. 14, 2011", 4 pgs.
"U.S. Appl. No. 12/098,869, Examiner Interview Summary mailed Dec. 14, 2011", 3 pgs.
"U.S. Appl. No. 12/098,869, Final Office Action mailed Sep. 1, 2011", 16 pgs.
"U.S. Appl. No. 12/098,869, Non Final Office Action mailed Jan. 20, 2011", 13 pgs.
"U.S. Appl. No. 12/098,869, Response filed Jun. 20, 2011 to Non-Final Office Action mailed Jan. 20, 2011", 9 pgs.
"U.S. Appl. No. 12/098,869, Response filed Nov. 15, 2010 to Restriction Requirement mailed Oct. 14, 2010", 8 pgs.
Clancy, David A, "Highlighting developments in hearing aids", Hearing Instruments, (Dec. 1995), 2.

* cited by examiner

EXPANDING BINAURAL HEARING ASSISTANCE DEVICE CONTROL

RELATED APPLICATION

This application is a continuation of and claims the benefit of priority under 35 U.S.C. §120 to U.S. patent application Ser. No. 11/625,736 entitled "EXPANDING BINAURAL HEARING ASSISTANCE DEVICE CONTROL," filed on Jan. 22, 2007, which is hereby incorporated by reference herein in its entirety.

TECHNICAL FIELD

This disclosure relates generally to hearing assistance devices, and more particularly to a control for adjusting parameters for binaural hearing assistance devices.

BACKGROUND

Hearing instruments are electronic devices that provide signal processing functions such as noise reduction, amplification, and tone control. In many hearing assistance devices these and other functions can be programmably varied to fit the requirements of individual users.

Hearing assistance devices, including hearing aids, for use in the ear, in the ear canal, completely in the canal, and behind the ear, have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification.

It is common that an individual's hearing loss is not uniform over the entire frequency spectrum of audible sound. An individual's hearing loss may be greater at higher frequency ranges than at lower frequencies. Recognizing these differentiations in hearing loss considerations between individuals, hearing health professionals typically make measurements that will indicate the type of correction or assistance that will be the most beneficial to improve that individual's hearing capability. A variety of measurements may be taken to determine the extent of an individual's hearing impairment. With these measurements, programmable parameters for fitting a hearing are determined. With modern hearing assistance devices having a multitude of adjustments and parameters such as multiple channels with different gains over different frequencies, a large number of parameters need to be adjusted to properly program hearing assistance devices.

There is a need in the art for improved systems for adjusting parameters for hearing assistance devices.

SUMMARY

The present subject matter includes a system for adjusting parameters for hearing assistance devices. A graphical user interface (GUI) control is provided for adjusting at least one parameter in at least one hearing assistance device. The control is indicative of status of at least one parameter for at least one device. When a pointer, controlled by a mouse or other selecting device, is placed over the control, the control expands to provide additional options for adjusting at least one parameter for at least one device. In various applications the control expands to display options for adjusting at least one of a left and a right device individually. In some applications, the control provides options to adjust at least one parameter of the left and right device together.

According to another embodiment, adjustment of both of the pair of hearing assistance devices is enabled using a control on the GUI. When a pointer is placed over the control, the control is expanded to display options for adjusting the left or right devices individually without losing the option to adjust binaurally.

Disclosed herein, among other things, is a method for adjusting at least one parameter in at least one of hearing assistance device. A control is provided for adjusting at least one parameter for at least one hearing assistance device. When a pointer is hovered over the control, the control expands to provide additional options for adjusting at least one parameter for at least one device. According to various embodiments, a computer-readable medium is programmed with computer-executable instructions for performing this method.

Disclosed herein, among other things, is a system for adjusting a parameter in at least one of a left and a right hearing assistance device. According to various embodiments, the system includes a monitor for displaying a graphical interface and a selection device for moving a graphical pointer displayed on the graphical interface. A computer is coupled to the monitor and the selection device. The computer is programmed to hover a pointer over a control to expand the control to provide additional options for adjusting at least one parameter for at least one device. In an embodiment, the additional options include a left slider and a right slider. The left slider represents a parameter of the left hearing assistance device and is adapted to adjust the parameter for the left device, and the right slider represents the parameter of the right hearing assistance device and is adapted to adjust the parameter for the right device. The computer is further programmed such that one or more of the left slider and the right slider is adjusted on the graphical display using the pointer.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive representations of the present subject matter.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and therefore not exhaustive, and the scope of the present subject matter is defined by the appended claims and their legal equivalents.

Figure 1:
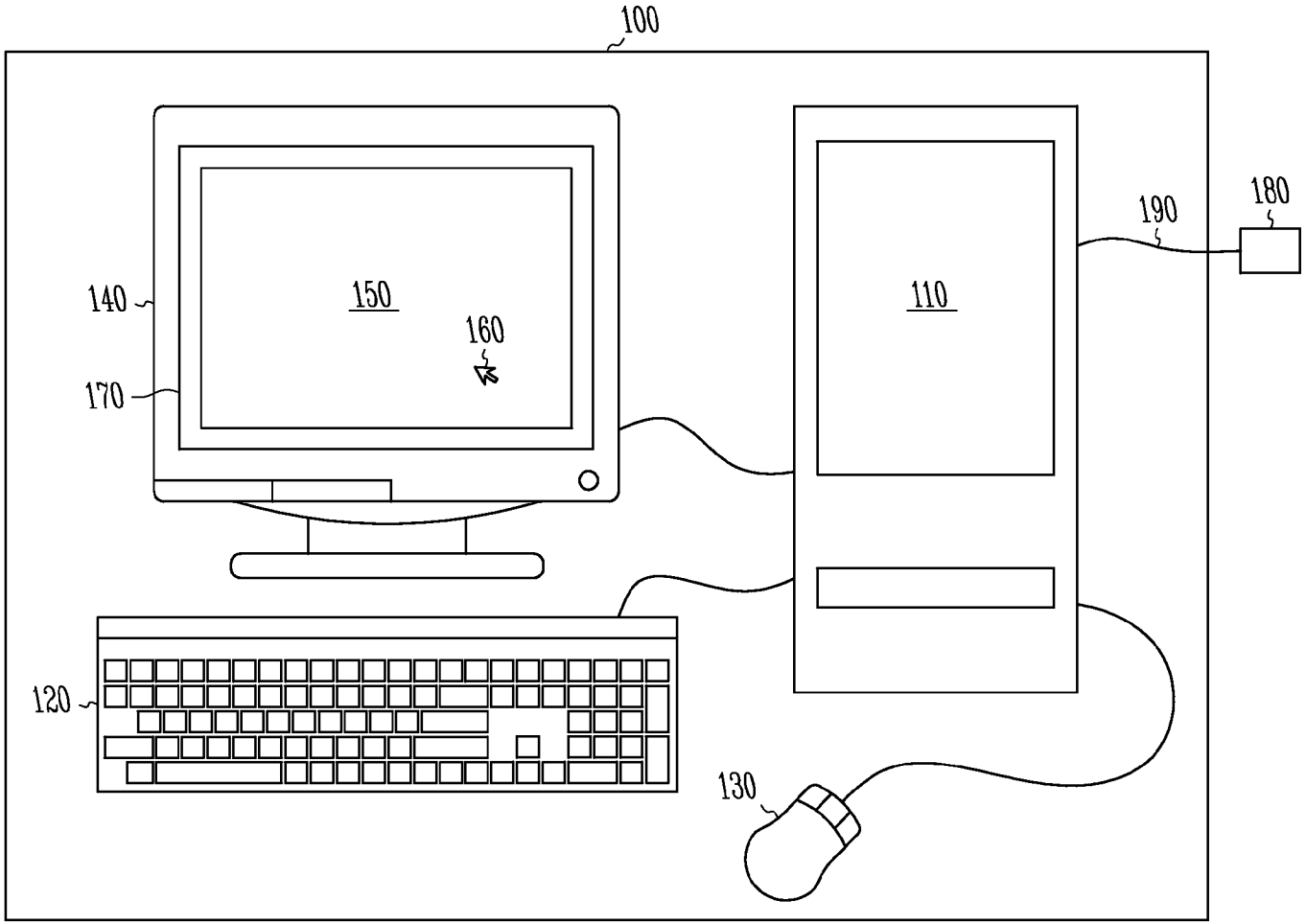
FIG. 1 illustrates a system for adjusting a parameter in a hearing assistance device, according to one embodiment.

FIG. 1 shows an embodiment of a system 100 for adjusting a parameter in a hearing assistance device, in accordance with the teachings of the present disclosure. The system includes a computer 110 coupled to a keyboard 120 and a mouse 130 to receive inputs from system users. System 100 also includes a monitor 140 coupled to computer 110 that provides a screen display 150 under the control of a program for providing information to a user and for interacting with the user. The movement of the mouse 130 is correlated to the movement of a pointer 160 on monitor display 170. The keys of the keyboard 120 can also be used to operate pointer 160 on monitor display 170. The computer is coupled to a hearing assistance device 180 by a medium 190 for transmitting to and receiving from hearing assistance device 180 parameters or information related to parameters for fitting hearing assistance device 180.

In various embodiments, computer 110 includes a personal computer in the form of a desk top computer, a laptop computer, a notebook computer, a hand-held computer device having a display screen, or any other computing device under the control of a program that has a display and a selection device for moving a pointer on the display. Further, computer 110 includes any processor capable of executing instructions for selecting parameters to fit a hearing assistance device using a graphical interface as screen display 150.

In various embodiments, monitor 140 includes a standalone monitor used with a personal computer, a display for a laptop computer, or a screen display for a hand-held computer. Further, monitor 140 includes any display device capable of displaying a graphic interface used in conjunction with a selection device to move objects on the screen of the display device.

In an embodiment, mouse 130 controls pointer 160 in a traditional "drag and drop" manner. Moving mouse 130 can direct pointer 160 to a specific location on monitor display 170. Mouse 130 can select an object at the specific location by actuating or "clicking" one or more buttons on the mouse. Then, the object can be moved to another location on monitor display 170 by moving or "dragging" the object with pointer 160 to the other location by moving mouse 130. Traditionally, to move the screen object the actuated button is held in the "click" position until pointer 160 reaches the desired location. Releasing the mouse button "drops" the object at the screen location of pointer 160. Additionally, with the cursor placed at one extreme of the slider path, clicking the mouse at that position moves the slider in the direction of the cursor. Alternately, an object could be moved by clicking the mouse with pointer 160 on the object, moving pointer 160 to the desired location on the monitor screen 170 and clicking another button of mouse 130. The pointer 160 can be moved to cover a slider or other element without clicking, and this is referred to as "hovering". In other embodiments, other selection devices are used to move objects on screen display 150. In one embodiment, keyboard 120 is used as a selection device to control pointer 160. In another embodiment, a stylus, as used with hand-held display devices, is used to control pointer 160.

Screen display 150 is a graphical interface operating in response to a program that allows a user to interact with computer 110 using pointer 160 under the control of a selection device such as mouse 130 and/or keyboard 120 in a point and click fashion. In one embodiment, the selection device is wirelessly coupled to computer 110. In one embodiment, a series of screen displays or graphical interfaces are employed to facilitate the fitting of hearing assistance device 180. The screen display 150 provides information regarding adjustable parameters of hearing assistance device 180. Data to provide this information is input to the computer through user input from the keyboard, from a computer readable medium such as a diskette or a compact disc, from a database not contained within the computer via wired or wireless connections, and from hearing assistance device 180 via medium 190. Medium 190 is a wired or wireless medium.

Medium 190 is also used to program hearing assistance device 180 with parameters for fitting hearing assistance device 180 in response to user interaction with the screen displays to determine the optimum values for these parameters. In one embodiment, medium 190 is a wireless communication medium that includes, but is not limited to, inductance, infrared, and RF transmissions. In other embodiments, medium 190 is a transmission medium that interfaces to computer 110 and hearing assistance device 180 using a wireless interface. In various embodiments the wireless interface can include standard or nonstandard communications. Some examples of standard wireless interfaces include, but are not limited to, FM, AM, SSB, BLUETOOTH™, IEEE 802.11 (wireless LANs) wi-fi, 802.15 (WPANs), 802.16 (WiMAX), 802.20, and cellular protocols including, but not limited to CDMA and GSM, ZigBee, and ultra-wideband (UWB) technologies. Such protocols support radio frequency communications and some support infrared communications. It is possible that other forms of wireless interfaces can be used such as ultrasonic, optical, and others. It is understood that the standards which can be used include past and present standards. It is also contemplated that future versions of these standards and new future standards may be employed without departing from the scope of the present subject matter. In various embodiments using these interfaces, hearing assistance device 180 includes a hearing aid and a peripheral unit removably coupled to the hearing aid for receiving the parameters from computer 110 to provide programming signals to the hearing aid. In another embodiment, a hearing aid is configured to receive signals directly from computer 110.

In one embodiment, system 100 is configured for fitting hearing assistance device 180 using one or more embodiments of graphical interfaces that are provided in the descriptions that follow. Further, computer 110 is programmed to execute instructions that provide for the use of these graphical interfaces for fitting hearing assistance device 180.

The term control is used herein to refer to a portion of a graphical user interface (GUI) for adjusting a parameter in hearing aids. In one embodiment, a control includes a graphical representation of status or level of a parameter (such as volume level) of a hearing assistance device. In another embodiment, a control includes an adjustment means, such as a slider, that is used to adjust the parameters in hearing aids. Various parameters that can be adjusted include, but are not limited to: band gain, channel gain (load and soft), output level, compression ratio, compression threshold knee points, grouped channel or band adjustments, volume control, expansion, noise management, feedback cancellation, and wind management.

The present subject matter relates to an expanding control that can adjust parameters in hearing aids. The expanding control can be used to view parameter status, or to adjust parameters singularly from the same control. In another embodiment, parameters can be adjusted for both left and right devices or for either the left or right device from the same control. This eases the burden of duplicated effort for adjusting the same control on both ears and avoids constraining an adjustment to a binaural only adjustment. A binaural adjustment refers to an adjustment of both left and right devices together. There is no need to navigate to another view or to select/de-select an additional option (or icon) to get the control to perform for both a single or binaural adjustment.

In one embodiment, the expanding control presents in a GUI as a display of status of a specific parameter for one or more hearing assistance devices. When the pointer 160 is hovered over the control, the control expands to display options for adjusting the left and/or right devices individually. In an embodiment, the pointer is hovered over the center of the control to expand the control. When a user removes focus from the expanding control it collapses back to its original size, in an embodiment. In an embodiment, focus is removed by moving the pointer away from the control. In another embodiment, the expanding control remains expanded until a next control gets focus with a click, such as by using a mouse or keyboard.

In various embodiments, the expanding control presents in a GUI as a single control for at least one parameter for one or more devices. When the pointer 160 is hovered over the control, the control expands to increase its functionality to allow more refined, complex, and/or extensive adjustments to the one or more devices.

According to an embodiment, expanding the control includes providing adjustment options for additional parameters for at least one device. Expanding the control includes providing adjustment options for at least one parameter for additional devices, in an embodiment. In various embodiments, expanding the control includes providing adjustment options for additional parameters for additional devices.

In varying embodiments, the expanding binaural control presents in a GUI as a single control for a specific parameter that when clicking on the top or bottom will increment or decrement the specific parameter on both the left and right devices equally. When the pointer 160 is hovered over the control, the control expands to display options for adjusting the left or right devices individually, without losing the option to adjust binaurally. Current and previous iterations of fitting software had controls that either adjusted one side or both directly. The user was required to either change between views (right/left) or to click on a linking icon that would force a control to adjust both sides at the same time.

Figure 2A:
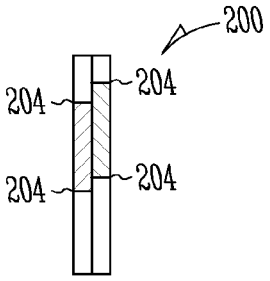
FIG. 2A illustrates a normal state of an expanding control for adjusting a parameter in a hearing assistance device, according to one embodiment.
Figure 2B:
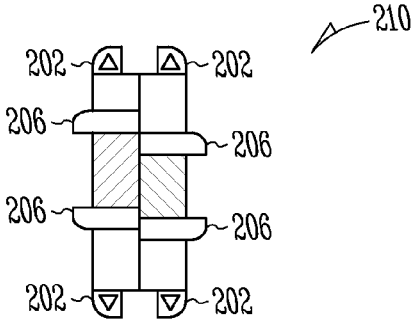
FIG. 2B illustrates an expanded state of an expanding control for adjusting a parameter in a hearing assistance device, according to one embodiment.

FIG. 2A through FIG. 4B illustrate examples of expanding controls for adjusting a parameter in a hearing assistance device. In FIG. 2A, the expanding control 200 is shown in its normal state, as a display of status of a specific parameter for right and left hearing assistance devices. The control 200 also shows levels and/or limits 204 to depict the status of a parameter to which the control is directed. For example, if the control related to volume, then the levels 204 could be to show volume settings and/or limits. In FIG. 2B, the control 210 is shown in its expanded state, after a pointer is hovered over the control. In the expanded state, the control 210 expands to display options for adjusting the left or right devices individually using push buttons 202 or sliders 206. It is understood that such buttons 202 could be pressed and/or sliders 206 could be dragged and dropped to make different levels and/or settings.

Figure 3A:
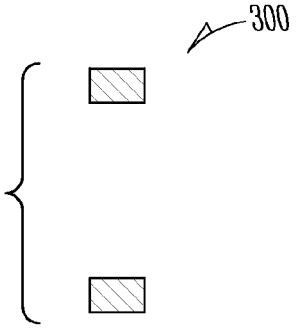
FIG. 3A illustrates a normal state of an expanding control for adjusting a parameter in a hearing assistance device, according to one embodiment.
Figure 3B:
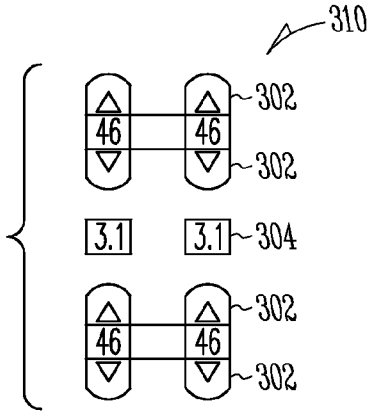
FIG. 3B illustrates an expanded state of an expanding control for adjusting a parameter in a hearing assistance device, according to one embodiment.

FIGS. 3A and 3B illustrate another embodiment of an expanding control for adjusting a parameter in a hearing assistance device. In FIG. 3A, the expanding control 300 is shown in its normal state, as a display of status of a specific parameter for one or more hearing assistance devices. The status could be a color, numeric or text output, for example in the shaded portion of FIG. 3A, or other indicator. In FIG. 3B, the control 310 is shown in its expanded state, after a pointer is hovered over the control. In the expanded state, the control 310 expands to display options for adjusting the left or right devices individually using push buttons 302. In the example of FIG. 3B, numerals are used to show a setting, however, it is understood that other indicators include text, colors, or other graphical depictions of status. It is possible to incorporate relative as well as absolute data in the control. For example, the output 304 could be a relative or absolute value, and could also be used for numerical entry.

Figure 4A:
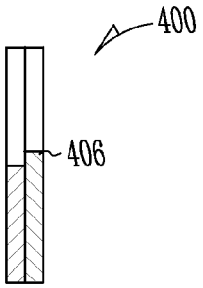
FIG. 4A illustrates a normal state of an expanding control for adjusting a parameter in a hearing assistance device, according to one embodiment.
Figure 4B:
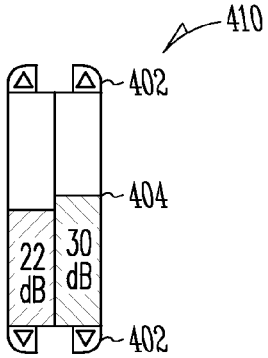
FIG. 4B illustrates an expanded state of an expanding control for adjusting a parameter in a hearing assistance device, according to one embodiment.

FIGS. 4A and 4B illustrate another embodiment of an expanding control for adjusting a parameter in a hearing assistance device. In FIG. 4A, the expanding binaural control 400 is shown in its normal state, as a display of status of a specific parameter for left and right hearing assistance devices. Setting 406 is graphically depicted for the left and right devices. In FIG. 4B, the control 410 is shown in its expanded state, after a pointer is hovered over the control. In the expanded state, the control 410 expands to display options for adjusting the left or right devices individually using push buttons 402. Thus, there is no need for a separate action or view to manipulate either the left or right device using the control. The control can feature enhanced outputs upon expansion. For example, the settings 404 can also show right and left hearing assistance device settings, such as 22 dB and 30 dB for example. Other outputs are possible without departing from the scope of the present subject matter.

Figure 5A:
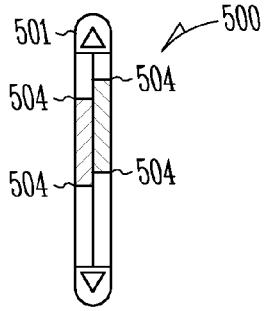
FIG. 5A illustrates a normal state of a binaural expanding control for adjusting a parameter in a hearing assistance device, according to one embodiment.
Figure 5B:
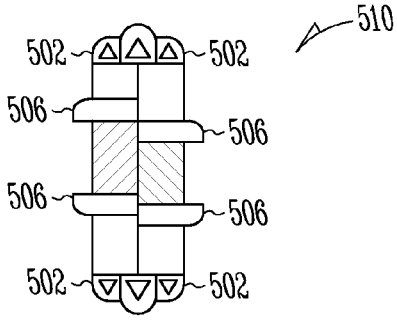
FIG. 5B illustrates an expanded state of a binaural expanding control for adjusting a parameter in a hearing assistance device, according to one embodiment.

FIG. 5A through FIG. 7B illustrate examples of a binaural expanding controls for adjusting a parameter in a hearing assistance device. In FIG. 5A, the expanding binaural control 500 is shown in its normal state, as a control for the right and left settings of a specific parameter. The settings for both left and right are adjusted by clicking on the top or bottom push control 501 to increase or decrease the specific parameter on both the left and right devices. In FIG. 5B, the control 510 is shown in its expanded state, after a pointer is hovered over the control. In the expanded state, the control 510 expands to display options for adjusting the left or right devices individually using push buttons 502, without losing the option to adjust binaurally using push button 501.

Figure 6A:
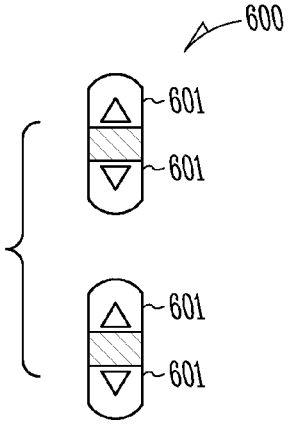
FIG. 6A illustrates a normal state of a binaural expanding control for adjusting a parameter in a hearing assistance device, according to one embodiment.
Figure 6B:
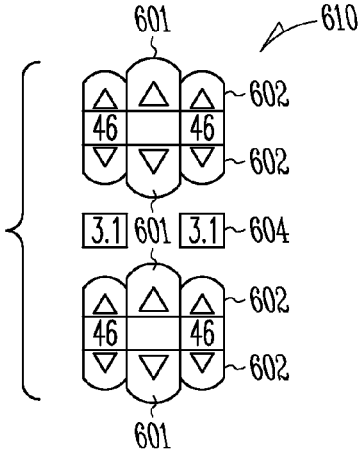
FIG. 6B illustrates an expanded state of a binaural expanding control for adjusting a parameter in a hearing assistance device, according to one embodiment.

FIGS. 6A and 6B illustrate another embodiment of a binaural expanding control for adjusting a parameter in a hearing assistance device. In FIG. 6A, the expanding binaural control 600 is shown in its normal state, as a single control for a specific parameter that when clicking on the top or bottom push control 601 will increment or decrement the specific parameter on both the left and right devices equally. In FIG. 6B, the control 610 is shown in its expanded state, after a pointer is hovered over the control. In the expanded state, the control 610 expands to display options for adjusting the left or right devices individually using push buttons 602, without losing the option to adjust binaurally using push button 601. The settings of 46 and 3.1 shown are examples of enhanced indicators available when using the control. Other numerical, text, and visual outputs are possible without departing from the scope of the present subject matter.

Figure 7A:
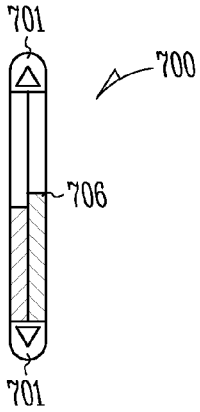
FIG. 7A illustrates a normal state of a binaural expanding control for adjusting a parameter in a hearing assistance device, according to one embodiment.
Figure 7B:
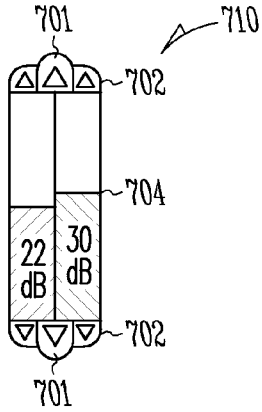
FIG. 7B illustrates an expanded state of a binaural expanding control for adjusting a parameter in a hearing assistance device, according to one embodiment.

FIGS. 7A and 7B illustrate another embodiment of a binaural expanding control for adjusting a parameter in a hearing assistance device. In FIG. 7A, the expanding binaural control 700 is shown in its normal state, as a single control for a specific parameter that when clicking on the top or bottom push control 701 will increment or decrement the specific parameter on both the left and right devices equally. In FIG. 7B, the control 710 is shown in its expanded state, after a pointer is hovered over the control. In the expanded state, the control 710 expands to display options for adjusting the left or right devices individually using push buttons 702, without losing the option to adjust binaurally using push button 701. Thus, there is no need for a separate action or view to manipulate one device or both devices using the same control. The settings of 22 dB and 30 dB shown are examples of enhanced indicators available when using the control. Other numerical, text, and visual outputs are possible without departing from the scope of the present subject matter.

Figure 8:
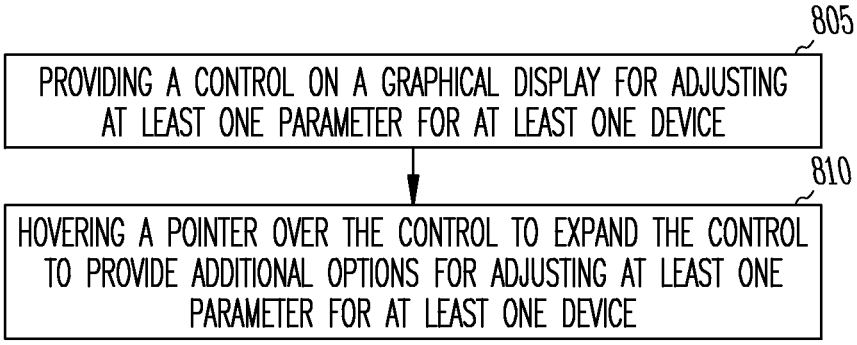
FIG. 8 illustrates a flow diagram of a method for adjusting a parameter for a hearing assistance device, according to one embodiment.

FIG. 8 illustrates a flow diagram of a method for adjusting at least one parameter in at least one hearing assistance device, according to one embodiment. A control is provided for adjusting at least one parameter for at least one hearing assistance device, at 805. When a pointer is hovered over the control, the control expands to provide additional options for adjusting at least one parameter for at least one device, at 810. According to varying embodiments, expanding the control includes: providing more extensive adjustment options for at least one parameter for at least one device; providing adjustment options for additional parameters for at least one device; providing adjustment options for at least one parameter for additional devices; and/or providing adjustment options for additional parameters for additional devices.

In one embodiment the at least one device includes a left and a right device, and hovering a pointer over a control to expand the control includes providing a left slider and a right slider. The left slider represents a parameter of the left hearing assistance device and is adapted to adjust the parameter for the left device, and the right slider represents the parameter of the right hearing assistance device and adapted to adjust the parameter for the right device. In an embodiment, adjusting one or more of the left slider and the right slider on the graphical display using the pointer. A third slider is provided on the graphical display in an embodiment, the third slider representing the parameter of both the left and right hearing assistance devices. The third slider is adapted to adjust the parameter for both the left and the right device, in an embodiment. In various embodiments, adjusting the sliders includes using the pointer to adjust the sliders. Hovering the pointer includes using a mouse to move the pointer over a center portion of the control, in varying embodiments.

Figure 9:
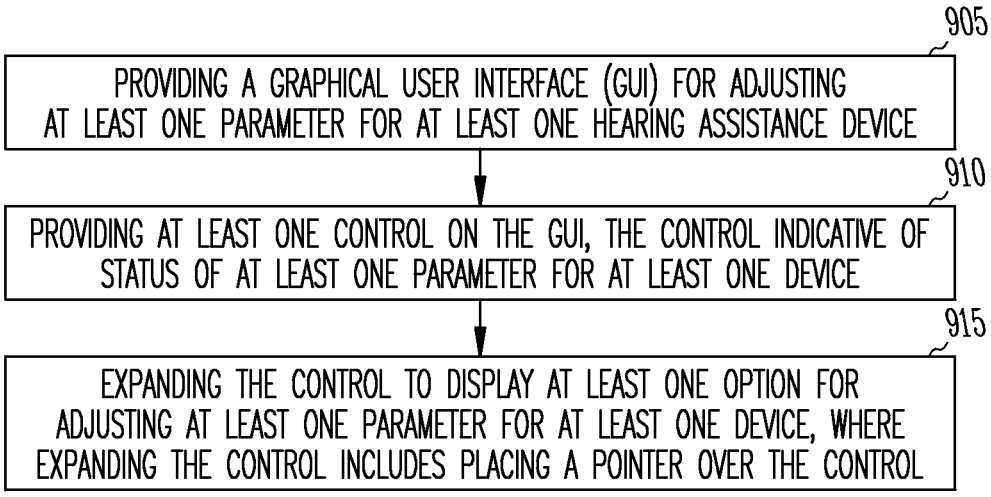
FIG. 9 illustrates a flow diagram of a method for adjusting parameters for hearing assistance devices, according to one embodiment.

FIG. 9 illustrates a flow diagram of a method for adjusting parameters for hearing assistance devices, according to one embodiment. A graphical user interface (GUI) is provided for adjusting at least one parameter in at least one hearing assistance device, at 905. According to an embodiment, at least one control is provided on the GUI at 910, and the control is indicative of status of at least one parameter for at least one device. At 915 a pointer, controlled by a mouse or other selecting device, is placed over the control, and the control expands to provide additional options for adjusting at least one parameter for at least one device. According to various embodiments, expanding the control to display options includes displaying options for adjusting left or right devices individually. Expanding the control to display options includes displaying options for adjusting both left and right devices together, according to an embodiment.

A graphical interface is disclosed for adjusting a parameter in at least one of a left and a right hearing assistance device. The interface includes one or more displays including at least one display element. The display element includes a control representing a status of a parameter of the hearing assistance devices. The display element further includes a left slider representing a parameter of the left hearing assistance device, where the left slider adjusts the parameter for the left device, and a right slider representing the parameter of the right hearing assistance device, where the right slider adjusts the parameter for the right device. A pointer is adapted to move the left and right sliders to adjust the parameter. Hovering the pointer over the control causes the right and left slider to be displayed. The pointer is adapted to move at least one of the right slider and the left slider to adjust the parameter, according to various embodiments.

According to an embodiment of the graphical interface, a display is proved including at least one display element, the display element including at least one control. An embodiment of the control has at least two modes. The modes include a first mode in which the control represents a status of a parameter of the hearing assistance devices, and a second mode in which the control expands and includes a left slider and a right slider, the left slider adapted for adjusting the parameter for the left device and the right slider adapted for adjusting the parameter for the right device. The control is switched from the first mode to the second mode by hovering a pointer over the control, in an embodiment. In various embodiments, the control is switched from the second mode to the first mode by removing the pointer from the control. The pointer is used to adjust at least one of the left slider and the right slider, in an embodiment.

It is understood one of skill in the art, upon reading and understanding the present application will appreciate that variations of order, information or connections are possible without departing from the present teachings.

Additionally, one of ordinary skill in the art will understand that, the systems shown and described herein can be implemented using software, hardware, and combinations of software and hardware. As such, the term "system" is intended to encompass software implementations, hardware implementations, and software and hardware implementations.

Although specific embodiments have been illustrated and described herein, it will be appreciated by those of ordinary skill in the art that other embodiments are possible without departing from the scope of the present subject matter.

We claim:

1. A graphical interface for adjusting at least one parameter in at least one of a left and a right hearing assistance device, comprising:

one or more displays including at least one display element comprising:

at least one control, the control having at least two modes, including:

a first mode in which the control includes a status of a parameter of the left and right hearing assistance devices; and a second mode in which the control expands upon selection to further include a left slider and a right slider, the left slider adapted for adjusting the parameter for the left hearing assistance device and the right slider adapted for adjusting the parameter for the right hearing assistance device.

2. The graphical interface of claim 1, wherein the control is switched from the first mode to the second mode by hovering a pointer over the control.

3. The graphical interface of claim 2, wherein the pointer includes a mouse to move the pointer.

4. The graphical interface of claim 1, wherein the control is switched from the second mode to the first mode by removing the pointer from the control.

5. The graphical interface of claim 1, wherein at least one of the left slider and the right slider is adjusted using the pointer.

6. The graphical interface of claim 1, wherein the control is adapted to provide one or more enhanced indicators for at least one parameter for at least one hearing assistance device when expanded.

7. The graphical interface of claim 6, wherein the enhanced indicators include numerical, text, color, indicators or a combination thereof.

8. A method, comprising:

providing a graphical interface for adjusting at least one parameter in at least one of a left and a right hearing assistance device, the graphical interface including one or more displays including at least one display element having at least one control, the control having at least two modes, including:

a first mode in which the control includes a status of a parameter of the left and right hearing assistance devices; and a second mode in which the control expands upon selection to further include a left slider and a right slider, the left slider adapted for adjusting the parameter for the left hearing assistance device and the right slider adapted for adjusting the parameter for the right hearing assistance device.

9. The method of claim 8, wherein the control is adapted to provide one or more enhanced indicators for at least one parameter for at least one hearing assistance device when expanded.

10. The method of claim 9, wherein the enhanced indicators include numerical, text, color, indicators or a combination thereof.

11. The method of claim 8, further comprising switching the control from the first mode to the second mode by hovering a pointer over the control.

12. The method of claim 11, further comprising switching the control from the second mode to the first mode by removing the pointer from the control.

13. The method of claim 11, further comprising adjusting at least one of the left slider and the right slider using the pointer.

14. The method of claim 11, wherein hovering the pointer includes a mouse to move the pointer over the control.

15. A graphical interface for adjusting at least one parameter in at least one of a left and a right hearing assistance device, comprising:

one or more displays including at least one display element comprising:

at least one control, the control having at least two modes, including:

a first mode in which the control includes a status of a parameter of the left and right hearing assistance devices, and the control includes a first slider adapted for adjusting the parameter for both the left and right hearing assistance devices; and a second mode in which the control expands upon selection to further include a left slider and a right slider, the left slider adapted for adjusting the parameter for the left hearing assistance device and the right slider adapted for adjusting the parameter for the right hearing assistance device.

16. The graphical interface of claim 15, wherein the control is switched from the first mode to the second mode by hovering a pointer over the control.

17. The graphical interface of claim 16, wherein the control is switched from the second mode to the first mode by removing the pointer from the control.

18. The graphical interface of claim 16, wherein at least one of the first slider and the left slider and the right slider is adjusted using the pointer.

19. The graphical interface of claim 16, wherein the pointer includes a mouse to move the pointer.

20. The graphical interface of claim 15, wherein the control is adapted to provide one or more enhanced indicators for at least one parameter for at least one hearing assistance device when expanded.

* * * * *

UNITED STATES PATENT AND TRADEMARK OFFICE

CERTIFICATE OF CORRECTION

PATENT NO. : 8,644,537 B1
APPLICATION NO. : 13/340092
DATED : February 4, 2014
INVENTOR(S) : Howes et al.

It is certified that error appears in the above-identified patent and that said Letters Patent is hereby corrected as shown below:

On the Title Page

On page 2, in column 2, Item (56) under "Other Publications", line 1, delete "mailed" and insert --filed--.

Signed and Sealed this
Eleventh Day of November, 2014

Michelle K. Lee

Michelle K. Lee
*Deputy Director of the United States Patent and Trademark Office*